US005957766A

United States Patent [19]

Kalokhe et al.

[11] Patent Number: 5,957,766

[45] Date of Patent: Sep. 28, 1999

[54] RELEASABLE CYLINDRICAL TOOL BODY

[75] Inventors: Shivdas Kalokhe, Holland; Mark L. Becksvoort, Hamilton, both of Mich.

[73] Assignee: Micromatic Operations, Inc., Holland, Mich.

[21] Appl. No.: 08/897,722

[22] Filed: Jul. 21, 1997

[51] Int. Cl.[6] ..... B24B 5/40

[52] U.S. Cl. ..... 451/470; 451/472; 451/476

[58] Field of Search ..... 451/476, 478, 451/472, 481, 470

[56] References Cited

U.S. PATENT DOCUMENTS 1,104,044 7/1914 Goetz .
2,787,865 4/1957 Gross .
3,380,137 4/1968 MacPetrie et al. .
3,893,267 7/1975 Swinehart et al. .
4,075,794 2/1978 Blaylock .
4,249,348 2/1981 Rutter .
4,254,591 3/1981 Sedgwick et al. .
4,449,328 5/1984 Gillette et al. .
4,991,361 2/1991 Huppert et al. .
5,050,352 9/1991 Estabrook et al. .
5,443,417 8/1995 Schimweg .

*Primary Examiner*—Timothy V. Eley
*Assistant Examiner*—Dung Van Nguyen
*Attorney, Agent, or Firm*—Perman & Green, LLP

[57] ABSTRACT

A tool body having a removable outer shell on which is mounted the abrasive elements of the tool. The shell is mounted on a mandrel which contains means to adjust the radial position of the abrasive elements which engage the adjustment means through slots in the shell.

6 Claims, 3 Drawing Sheets

RELEASABLE CYLINDRICAL TOOL BODY

BACKGROUND OF THE INVENTION

Machines for boring and finishing cylindrical holes such as engine cylinder bores use a tool having abrasive strips mounted on a cylindrical body. As these tools wear, they are generally adjusted radially outward to compensate for the depletion of the abrasive surface. The wear compensating adjustment mechanism forms part of the tool body and comes in many shapes and sizes for example the tool shown and described in U.S. Pat. No. 4,075,794. These tools consist of a mandrel which connects to the machine spindle at one end and is constructed with an abrasive head at the other. A connecting rod connects to an adjustment mechanism within the abrasive head to bias the abrasive elements radially outward against the work piece. The adjustment can be accomplished automatically as shown in the '794 patent or manually as shown in the reference Gross, U.S. Pat. No. 2,787,865.

The problem with tools of this type is that they are complex mechanisms which have to be continuously removed from the machine spindles for repairs, replacement of abrasives and maintenance. Each time this occurs, an expensive part of the machine is unproductive. It requires skill and care to make sure that the tool mechanism is properly installed. Since the tool assembly of the prior art may weigh between 15 and 20 pounds, servicing of this element becomes a significant effort and is awkward for a single operator to accomplish.

It is the purpose of this invention to provide a tool body which is removable from the mandrel in a convenient and reliable manner to allow maintenance of the abrasive elements without extensive effort. The tool body of this invention significantly reduces the weight which needs to be handled during servicing or replacement of the abrasive elements and this tool body is a much less expensive part to replace than comparable parts in the prior art. Removal of the tool body of this invention can be accomplished without disconnecting the air gauge as required in prior art systems. This avoids contamination thereby improving accuracy, and saving time.

SUMMARY OF THE INVENTION

A tool body for use in a honing machine is constructed in the form of a cylindrical shell having an internal axially extending bore open at its outer and inner ends. A plurality of axial aligned channels designed to receive the abrasive assemblies are formed in its outer periphery. Each abrasive assembly consists of a specially designed tool holder and an abrasive element. The assemblies are held in place by flexible rings which allow radial movement of the element within its channel. At the bottom of each channel is an elongated slot which provides access to the tool holder from the internal bore for the expander mechanism. At the entrance to the bore at its inner end, a torque transmitting engagement surface is formed. A mandrel is constructed to house the expander mechanism for the abrasive assembly and is connected to the spindle of the machine through an elongated shaft. The mandrel is designed for insertion into the internal bore of the tool body to allow the tool body to be removably mounted thereon. A fixed drive element projects radially outward from the periphery of the mandrel to engage the torque transmitting surface of the tool body in a mating relation to transmit torque to the tool body. The expander mechanism is designed to convert an axial force down the shaft of the mandrel to a radial force directed outward on the tool holders through a series of wedge shaped surfaces.

DESCRIPTION OF THE DRAWING

The invention is described in more detail below with reference to the attached drawing in which.

DESCRIPTION OF THE PREFERRED EMBODIMENT

Figure 5:
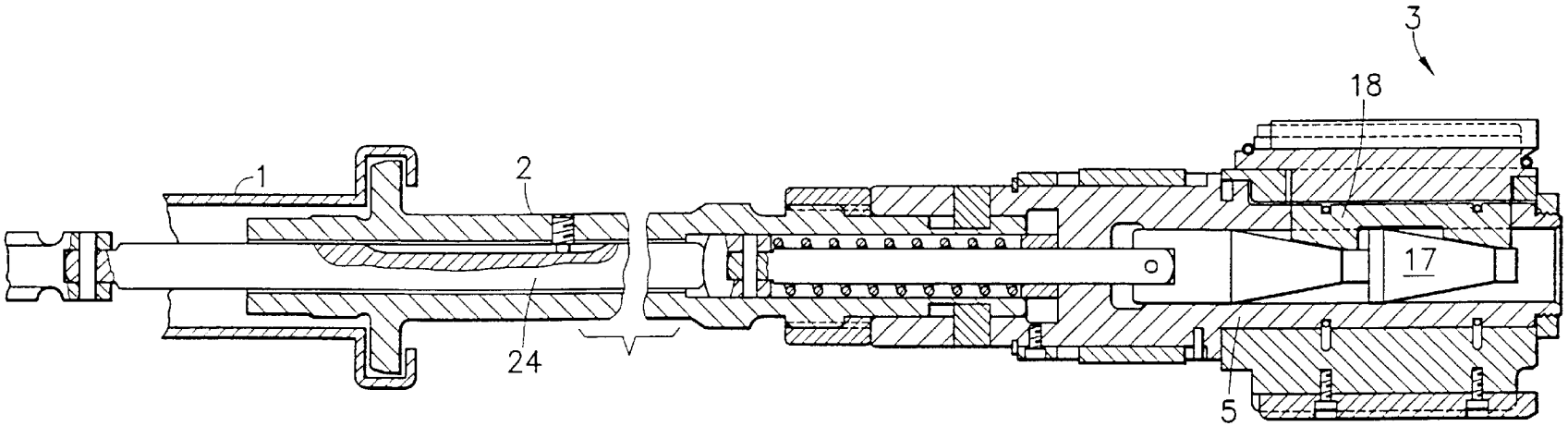
FIG. 5 is a cut away view of the entire tool assembly from tip to spindle.

A tool mechanism, as shown in FIG. 5, is constructed for installation on spindle 1 of a honing machine (not shown). The tool consists of an elongated support shaft 2 and tip 3. It is the assembly of tip 3 to which this invention is directed.

Figure 1:
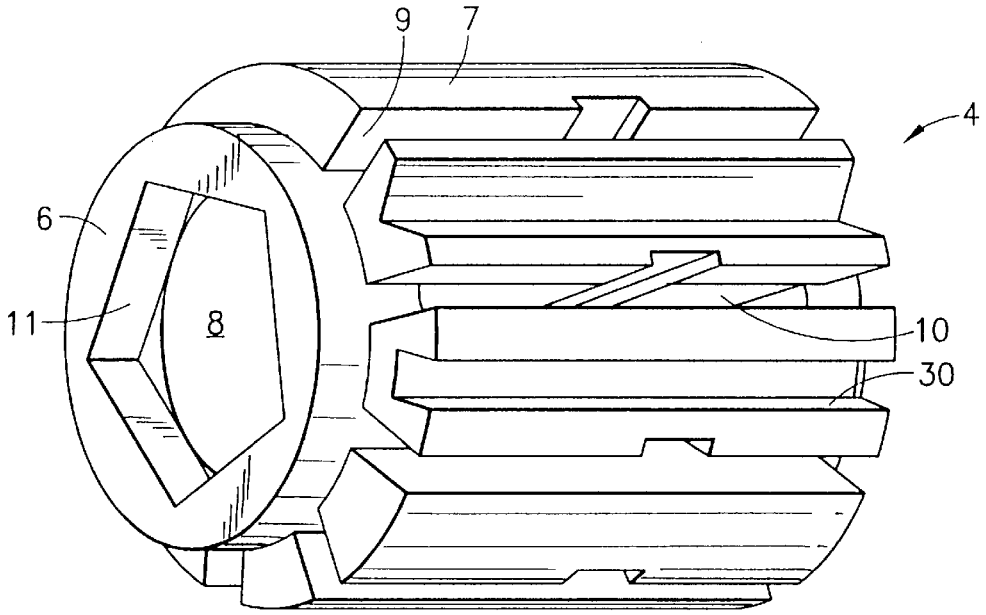
FIG. 1 is a perspective view of the tool body of this invention.
Figure 3:
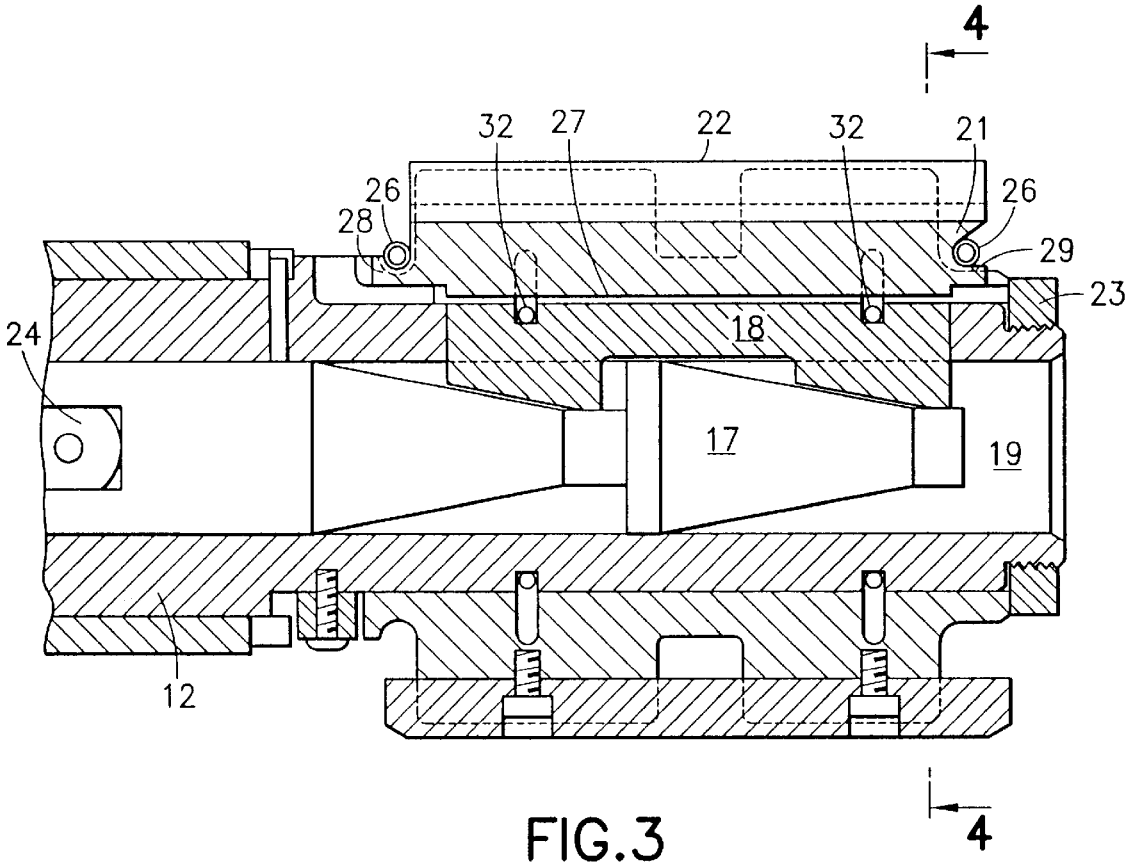
FIG. 3 is a cut away view of the mandrel and tool body assembly showing the internal parts of the expander mechanism.
Figure 4:
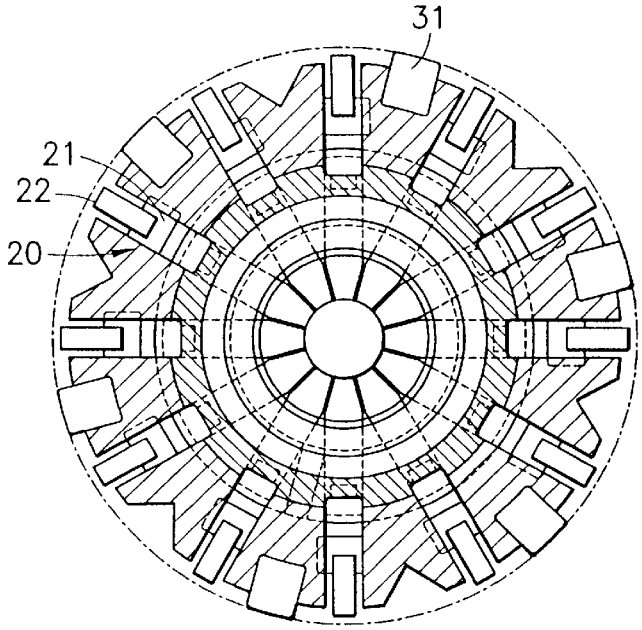
FIG. 4 is an end view of the mandrel and tool body assembly at section lines 4—4.

Tip 3 is an assembly of tool body 4 and mandrel 5. As shown in FIG. 1, tool body 4 is constructed as a shell having an outer periphery 7, an inner end 6, and an internal axial bore 8. Abrasive channel 9 are formed in the outer periphery 7 and extend axially to receive an abrasive assembly 20. The abrasive assembly 20 consists of a holder 21 and an abrasive block 22. The abrasive holder 21 is constructed with a bottom surface 27 for engagement with the expander element 18, described below. Holder 21 is held in place by O-ring type elastic springs 26, as shown in FIG. 3. Springs 26 engage projections 28 and 29 on either end of the holder 21. Guide receiving channels 30 extend axially on the body 4 to receive guides members 31.

Elongated slots 10 are constructed at the base of the channel 9 which communicate with the internal bore 8 to provide access to the abrasive holder 21 from within. Inner end 6 contains a pentagonal recess 11 to receive a mating drive surface 15 on the mandrel 5. Although a pentagonal head engagement is illustrated, any appropriate engagement can be made to allow transmission of torque directly to the tool body 4. For example, a lug and slot or gear type engagement would work also.

Figure 2:
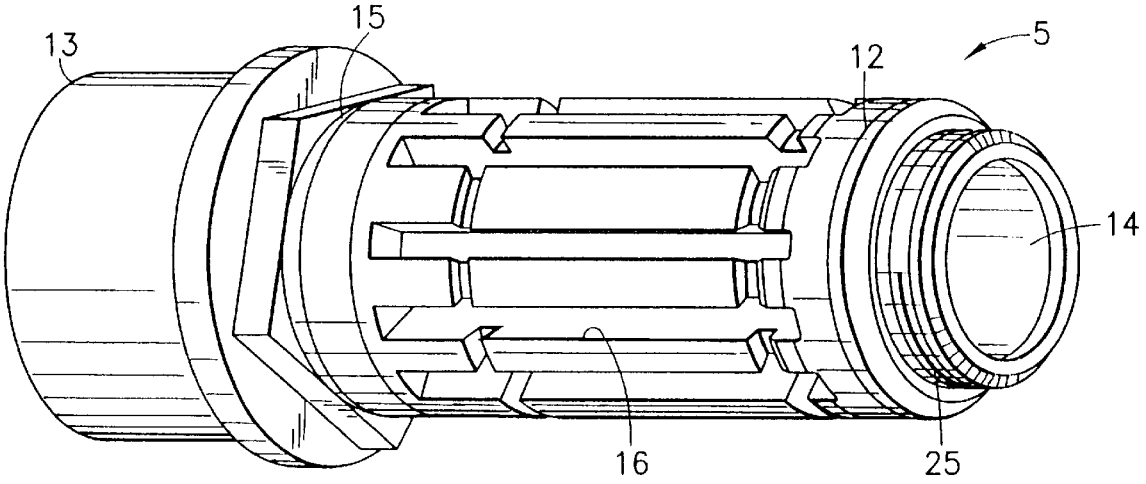
FIG. 2 is a perspective view of the mandrel of this invention.

The mandrel 5 of this invention is shown in FIG. 2. Mandrel 5 is constructed with cylindrical housing extending from inner end 13 to outer end 14, and sized to fit into the bore 8 of tool body 4. Mandrel 5 houses the tip portion of the expander mechanism identified by elements 17 and 18 shown in FIG. 3. The cam element 18 is held in place by elastic springs 32. The mandrel 5 has a drive surface 15 extending radially outward from its inner end 13 with a pentagonal shape to mate with the recess 11 of tool Body 4. The housing 12 is constructed with an inner chamber 19 in which the expander mechanism extends. Housing 12 is constructed with slots 16 through which the expander element 18 extends for operative engagement with the bottom surface 27 of holder 21. This engagement is accomplished through the aligned slots 10 in tool body 4 and slots 16 in mandrel housing 12. The outer end 14 of mandrel 5 has a threaded portion 25 to receive the threaded end cap 23 which serves to secure the tool body 4 on the mandrel 5.

As shown in FIG. 5, the expander cam 17 is mounted at the tip end of an adjustment rod 24 which extends longitudinally within the support shaft 2 and connects with appropriate operating mechanisms within the spindle 1. The actuating rod 24 pushes downward causing cam 17 outward. A radial force is exerted on expander element 18 which is in contact with the surface 27 of holder 21. Axial movement of the adjustment rod 24 will, therefore, move the abrasive assembly 20 outward to compensate for wear.

In operation, when repairs, maintenance, or replacement need to be accomplished only the tool body 4 needs to be removed. It can easily be removed by unscrewing end cap 23. Since only the tool body is needed, it is economical to have multiple replacement bodies in inventory. This would not be feasible without the releasable tool of this invention.

We claim:

1. A tool assembly for use on a machine having a spindle for driving a tool to machine cylindrical bores comprising:

a tool body constructed in the form of a cylindrical shell having an internal axial bore, said shell having a plurality of channels formed in the outer periphery thereof, each channel having a slot constructed in the bottom thereof communicating with said internal axial bore, said body also having torque receiving means constructed therein;

a plurality of abrasive assemblies mounted within the channels for radial movement with respect to the tool body; and means mounted in the axial bore of the tool body to removably support the tool body on the spindle, said mounting means including expander means in operative association with the abrasive assemblies through the channel slots to allow the adjustment of the radial position of said abrasive assemblies.

2. A tool assembly for use on a machine having a spindle for driving a tool to machine cylindrical bores as described in claim 1 wherein the mounting means further comprises:

a mandrel having a housing constructed to fit into the axial bore of the tool body to allow said tool body to be removably mounted thereon, said housing having an inner chamber constructed therein and slots communicating with the inner chamber, said housing slots aligning with the slots of the tool body channels to form a continuous passage that permits access to the abrasive assembly from the inner chamber of the mandrel, said mandrel having torque transmitting means constructed therein to operatively engage the torque receiving means of the tool body; and wherein the expander means is mounted within the inner chamber of said mandrel and engage the abrasive assemblies through the aligned slots of the mandrel and tool body.

3. A tool assembly for use on a machine having a spindle for driving a tool to machine cylindrical bores as described in claim 1, wherein the abrasive elements are resiliently held in place within the channels by means of springs.

4. A tool assembly for use on a machine having a spindle for driving a tool to machine cylindrical bores as described in claim 1 wherein the adjustment means comprises:

a primary adjustment element having a first cam surface, mounted with the mandrel chamber and connected to an external actuator which causes axial movement of the cam surface within the chamber;

a plurality of secondary adjustment elements each having a second cam surface operatively engaging said first cam surface and each having a contact portion projecting radially outward therefrom aligned with the slots of the mandrel housing, said contact portion moving radially in response to axial movement of the first cam surface; and contact means on each of the abrasive assemblies aligned with the slots of the channels to engage the contact portion of the secondary adjustment elements for movement therewith.

5. A tool assembly for use on a machine having a spindle for driving a tool to machine cylindrical bores as described in claim 1, wherein each of the abrasive assemblies comprises:

a holder adapted to receive an abrasive block, said holder constructed to fit within a channel of the tool body, and having engagement means constructed at a bottom surface in alignment with a slot in the channel; and an abrasive block mounted on the holder and extending outward therefrom to engage the cylindrical bore to be machined.

6. A tool assembly for use on a machine having a spindle for driving a tool to machine cylindrical bores as described in claim 5, wherein the abrasive assemblies are held in place by resilient securing means comprising:

an extension constructed at each end of the holder protruding axially beyond the channels; and a ring spring encircling the extensions to exert a radially inward force thereon.

* * * * *